United States Patent [19]

Christoffel

[11] 4,186,732

[45] Feb. 5, 1980

[54] METHOD AND APPARATUS FOR PULSING A BLOOD FLOW STIMULATOR

[75] Inventor: William D. Christoffel, Two Rivers, Wis.

[73] Assignee: American Hospital Supply Corporation, Evanston, Ill.

[21] Appl. No.: 857,312

[22] Filed: Dec. 5, 1977

[51] Int. Cl.[2] ..... A61H 1/00

[52] U.S. Cl. ..... 128/24 R

[58] Field of Search ..... 128/2.05 M, 24 R, 28, 128/30, 30.2, 64, 297, 298, 299, DIG. 10, DIG. 20, 327; 137/87, 624.11-624.16

[56] References Cited

U.S. PATENT DOCUMENTS

| | | | |
|---|---|---|---|
| 2,140,898 | 12/1938 | Collens et al. | 128/299 |
| 2,145,932 | 2/1939 | Israel | 128/299 |
| 2,674,231 | 4/1954 | Erickson | 128/24 R X |
| 2,781,041 | 2/1957 | Weinberg | 128/299 X |
| 3,094,983 | 6/1963 | Macleod | 128/299 X |
| 3,177,866 | 4/1965 | Wesslund | 128/24 R |
| 3,303,841 | 2/1967 | Dennis | 128/24 R |
| 3,391,692 | 7/1968 | Spielberg | 128/24 R |
| 3,862,629 | 1/1975 | Rotta | 128/24 R |
| 3,892,229 | 7/1975 | Taylor et al. | 128/24 R |
| 3,901,221 | 8/1975 | Nicholson et al. | 128/24 R |
| 3,942,518 | 3/1976 | Tenteris et al. | 128/24 R |
| 3,976,056 | 8/1976 | Brawn | 128/24 R |
| 4,029,087 | 6/1977 | Dye et al. | 128/24 R |
| 4,030,488 | 6/1977 | Hasty | 128/24 R |
| 4,054,129 | 10/1977 | Byars et al. | 128/24 R |
| 4,077,402 | 3/1978 | Benjamin et al. | 128/24 R |
| 4,116,230 | 9/1978 | Gorelick | 128/2.05 M |
| 4,153,050 | 5/1979 | Bishop et al. | 128/24 R X |

FOREIGN PATENT DOCUMENTS

| | | | |
|---|---|---|---|
| 1426439 | 2/1976 | United Kingdom | 128/24 R |

*Primary Examiner*—Richard J. Apley
*Attorney, Agent, or Firm*—Larry N. Barger

[57] ABSTRACT

A method and apparatus for sequentially inflating and deflating a compression device or the like to stimulate blood flow and prevent deep vein thrombosis. The apparatus includes an air compressor with a regulator valve providing fast inflation of such device to a pressure of approximately 60 mm Hg (1.2 psi) within 3 to 7 seconds. A pulse timer and a delay timer in the system are coupled together for actuating the compressor and a pressure relief valve to peak and maintain a pressure in the device for a measured period of time.

20 Claims, 4 Drawing Figures

FIG. 1
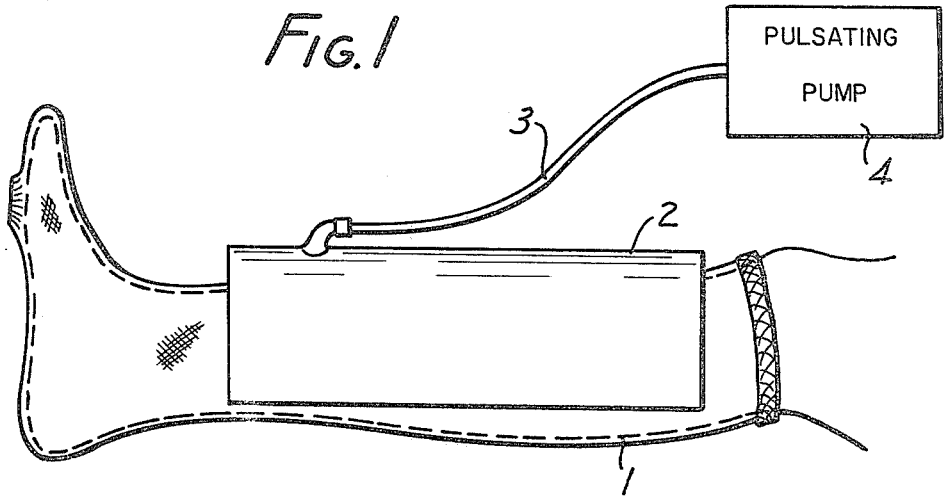
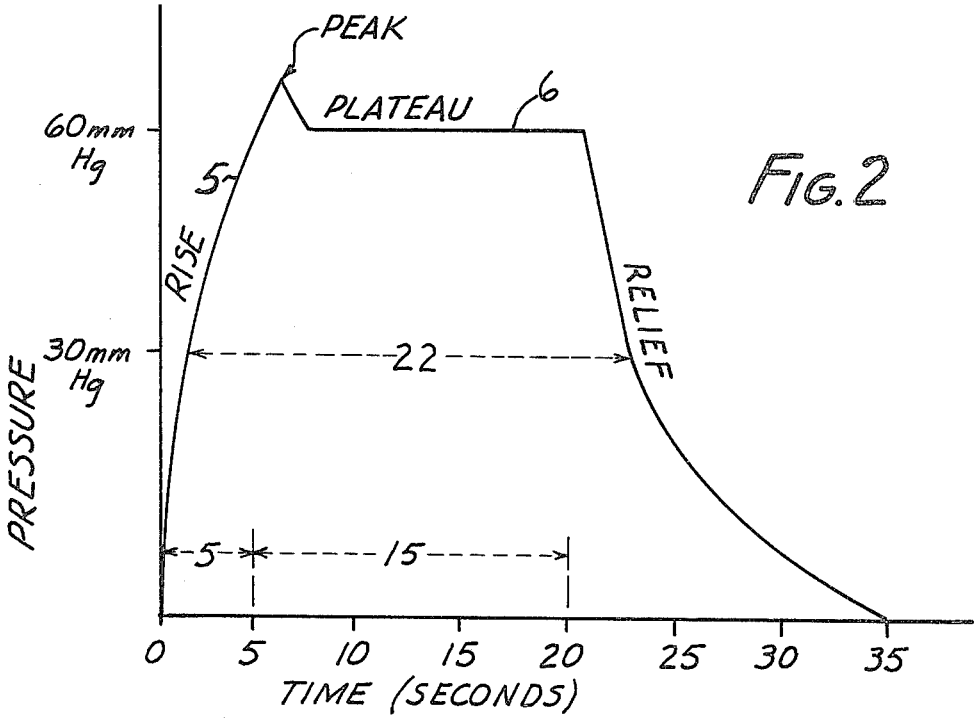
FIG. 2

METHOD AND APPARATUS FOR PULSING A BLOOD FLOW STIMULATOR

BACKGROUND OF THE INVENTION

There have been various body compressing devices proposed to sequentially squeeze a patient's limbs, usually the legs, to aid in blood circulation. Such compression devices are intended to prevent pooling of blood in limb extremities where a deep vein thrombosis (blood clot) can form.

One type of patient limb compression device is described in a co-pending application by Bishop and Choksi, entitled Pulsatile Stocking and Bladder Therefor, Ser. No. 820,104, filed July 29, 1977, now U.S. Pat. No. 4,153,050. The subject matter of the present application deals with an improved pumping system for sequentially inflating a limb compressing device, such as the stocking described in the above co-pending application.

It has been known to use air compressors, and tanks of compressed air to inflate body compressing devices, which were thereafter deflated by venting a valve to the atmosphere. Examples of such inflation systems are described in U.S. Pat. Nos. 2,140,898; 2,145,932; 2,674,231; 3,901,221; and 3,942,518. The inflation systems described in this prior art would either provide a very slow rise time to the desired pressure, or include large cumbersome compressed air tanks or compressors that are not easily portable throughout the hospital. It is noted that the compact air supply unit described in the present application may be conveniently disconnected from the stocking described in the above copending Bishop and Choksi application. The stocking/bladder device is lightweight and pliable permitting ambulatory patients to walk while still wearing such stockings.

It has also been determined that blood circulation is improved if the compression device is quickly inflated to a slight pressure peak, 5 to 10 mm Hg above its desired plateau pressure, and held at a generally constant plateau pressure for more than 10 seconds, and then deflated. The prior inflation systems for limb compressing devices inflated them in either one or two steps to a peak pressure point and immediately deflated the device. With such arrangement, much of the blood flow stimulation occurs at less than peak pressure. It is believed that a greater volume of blood can be pumped through the limb with a compression cycle that has a generally constant plateau pressure for a considerable period of time.

SUMMARY OF THE INVENTION

The present invention provides an improved inflation system for a limb compressing device that can provide a fast rise time of 50 to 70 mm Hg (1 to 1.4 psi) in a period of 3–7 seconds, and thereafter maintain a generally constant plateau pressure at this level for at least 10 seconds. The system has a small portable air compressor, weighing approximately 9 pounds, with an output pressure of greater than 520 mm Hg (10 psi). A regulator off the compressor establishes an intermediate supply pressure in the range of 110 to 520 mm Hg (2 to 10 psi) for inflating the device to a pressure peak and plateau pressure below 110 mm Hg (2 psi). After the quick rise time, the generally constant plateau pressure is maintained by a pressure relief valve that permits excess air to escape from the compressor.

At the end of the pressure cycle, a portion of the air is forced out of the device through the connecting tubing and out of the exhaust port of the 3-way valve. The air evacuates due to the force created as the patient's leg expands back to its normal size, due to elasticity of the stocking and due to atmospheric pressure. Air in the device remains at atmospheric pressure until the next pressure cycle. Actuation of the above cycle is controlled by a pulse timer and a delay timer coupled together for operating the compressor, two 3-way valves and a rise time valve provided with a preset pressure relief valve set at the desired plateau pressure. The pulse timer actuates a flip-flop relay to alternate the pressure cycle to either the right or left leg.

THE DRAWINGS

FIG. 1 is a side elevational view of a patient limb compression device that is inflated and deflated by the system of this invention;

FIG. 2 is a graph showing the preferred fast rise time, generally constant plateau pressure and decompression of the device;

DETAILED DESCRIPTION

Figure 3:
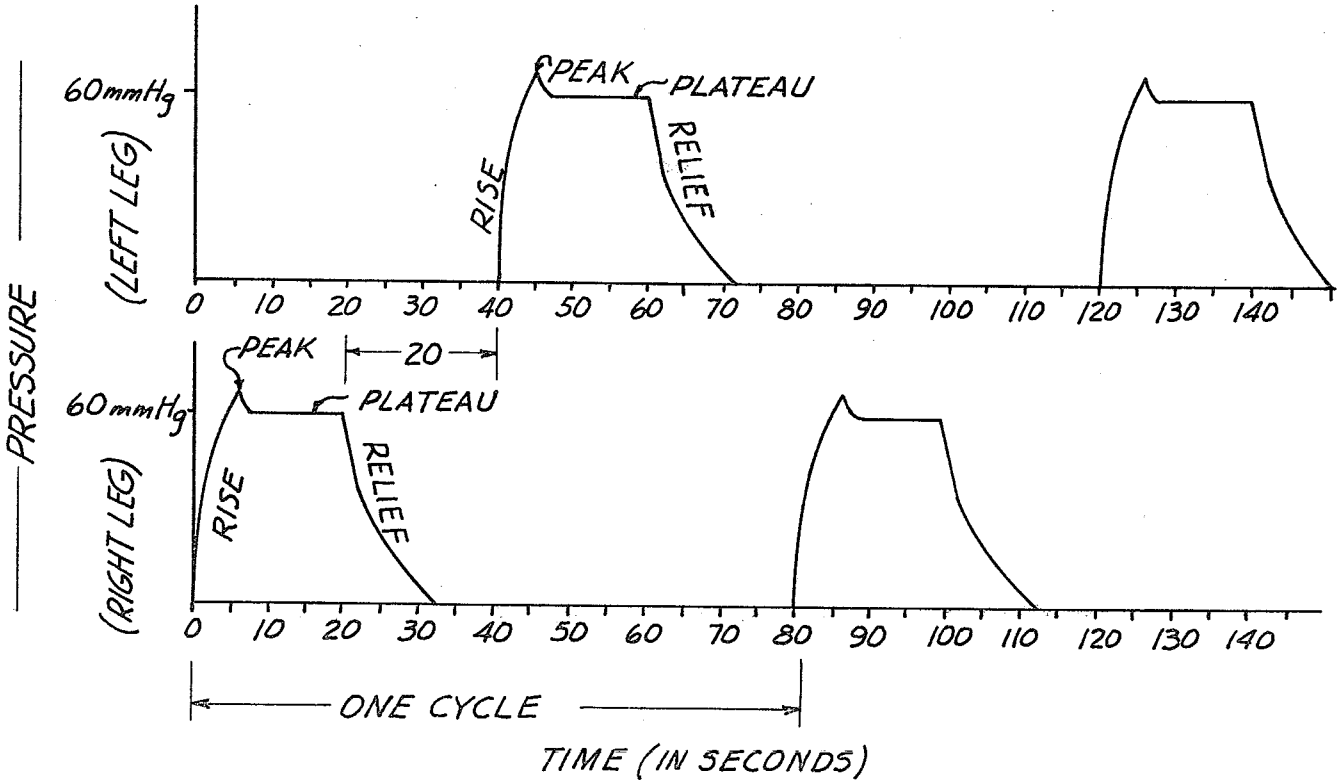
FIG. 3 is a graph showing the sequence of pulse cycles between devices on both legs of a patient.

FIG. 1 shows a schematic view of a limb compression device 1, such as a stocking, that has a bladder chamber 2 into which fits an inflatable bladder (not shown). A tube 3 connects a bladder within chamber 2 to a pulsing pump device 4. The stocking and bladder form no part of this invention and are shown only for background information. This invention relates to the pulsating pump device 4 and to its structure and method of inflating the patient compression device.

The pumping device 4 is a small portable unit weighing only approximately 16 pounds. To provide a very quick and reliable rise time in inflating the bladder, the compressor has an output of more than 520 mm Hg (10 psi). An output of 780 mm Hg (15 psi) works very well, but the output pressure could be 1040 mm Hg (20 psi), if desired. The compressor provides air to the system controlled by a pressure regulator 30 (FIG. 4), to provide an intermediate control pressure of approximately 260 mm Hg (5 psi). Depending on the rise time and plateau pressure desired, this intermediate control pressure could be within the range of 140 mm Hg (2 psi) to 520 mm Hg (10 psi).

Figure 4:
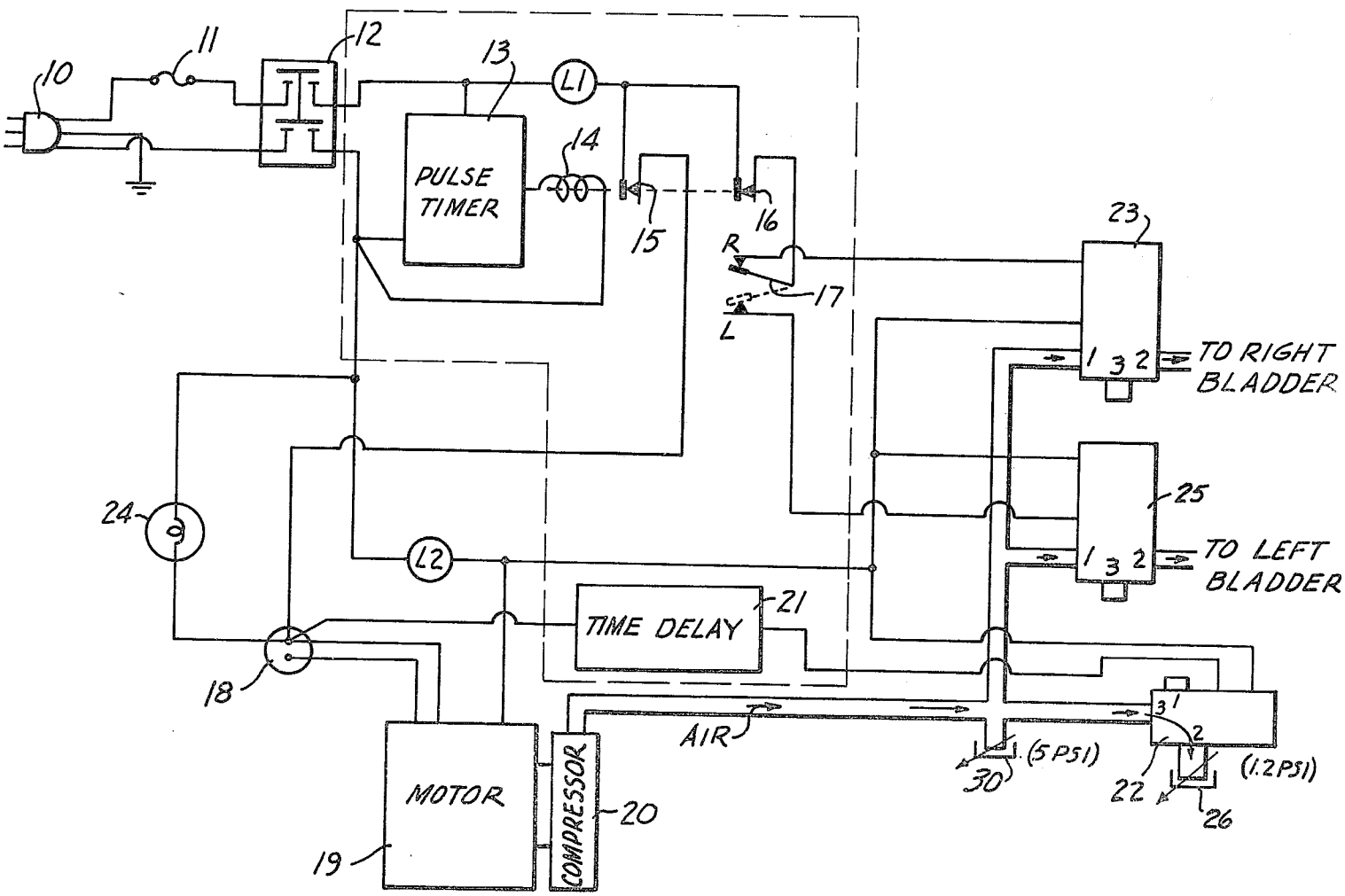
FIG. 4 is a schematic view of the electrical and air circuits of the inflation system.

An air compressor that merely puts out 260 mm Hg (5 psi) could be more likely to vary in its output pressure under differing loads on the motor during start up, etc. This could change the inflation pressure at the 5 second delay time. A compressor has been previously tried which put out 260 mm Hg (5 psi), but it was unsuccessful because of the inordinately long period of time it took to inflate the bladder. It might be possible that a compressor putting out 260 mm Hg (5 psi) which included a very large compressed air storage tank, such as used in gasoline stations to inflate tires, might provide the proper inflation time because of the large backup air supply reservoir. However, such large and cumbersome compressor would not be practical for portable hospital use. The compressor described in the present application is preferably used without a storage tank to reduce costs and weight. In applicant's device compressed air from the 260 mm Hg (5 psi) regulator valve 30 (FIG. 4)

valve is supplied directly to the compression stocking to inflate its bladder to approximately 60 mm Hg (1.2 psi) in the preferred 5 second time. There is no storage tank.

As shown in FIG. 2, the fast rise portion is shown as numeral 5 on the graph. The pressure reaches a peak, preferably in the range of 5 to 10 mm Hg above the plateau pressure of 50 to 70 mm Hg, in a period of 3 to 7 seconds. The pressure increase is then halted with a timing means to establish a generally constant plateau pressure for at least 10 seconds (shown in FIG. 2 as approximately 14 seconds). In FIG. 2, this plateau pressure is illustrated as 60 mm Hg, and after approximately 14 seconds, a timing means actuates the deflation of the bladder.

From FIG. 2 it can be seen that the pressure is maintained above 30 mm Hg (0.6 psi) for a considerably long time, i.e. 20 seconds, but could be in the range of 15 to 25 seconds. The plateau pressure, approximately 60 mm Hg (1.2 psi), is maintained for at least 10 seconds at a generally constant pressure. While it is recognized there might be slight fluctuations in the plateau pressure, such fluctuations would be within a pressure range of 8 mm Hg or less.

The pressure versus time graph of FIG. 2 shows only the sequence of the inflation, pressure peak, plateau, and relief (deflation). FIG. 3 shows how these sequences are combined for alternating pulses between the patient's left and right legs which both have compression devices, such as shown in FIG. 1. For each leg, the cycle is approximately 80 seconds long and thereafter repeats itself. It is noted in FIG. 3 that the rise time plus the peak and plateau time for one leg is 20 seconds, while the time between terminating the plateau pressure of that particular leg and start of the rise time of the opposite leg is also 20 seconds. Therefore, a simple alternating or pulse timer, as will be explained later, can control a compressor output with a repeating timing sequence of 20 seconds "on" and 20 seconds "off". For purposes of this application, the rise time is defined as the time to reach the peak pressure. It is understood that the peak pressure is shown schematically and in practice may have a more tapered blending with the plateau pressure.

Still referring to FIGS. 2 and 3, the sharp rise time of approximately 5 seconds to approximately 70 mm Hg (1.4 psi) is controlled by a 5 second delay timer. The tolerance on such timer is between 4.5 and 5.5 seconds. In FIG. 2 as the compressor starts to inflate the bladder of the compression device, the delay timer kicks in after 5 seconds and opens a valve that is set at 60 mm Hg (1.2 psi). This causes the pressure rise to stop and establish a generally constant plateau pressure for a period of 10 seconds or more. It has been found that the peak and the plateau pressures are more easily controllable by measuring the time rather than the pressure. Because of a controlled intermediate pressure from regulator 30 supplying the stocking bladder, a given period of time, i.e. 5 seconds, will establish the desired peak and plateau pressure of approximately 70 mm Hg and 60 mm Hg respectively.

The interrelationship between the pulse timer and delay timer which are electrically coupled is best seen in FIG. 3. At time zero, the pulse timer begins its "on" cycle for 20 seconds, and at the same time the 5 second delay timer begins its count. At the end of 5 seconds, the peak pressure of approximately 65–70 mm Hg has been reached. The delay timer actuates solenoid valve 22 so that an approximately constant plateau pressure is maintained. Because the compressor is still running while air is bleeding out of the solenoid valve 22 and pressure relief valve 26, this tends to dampen out the fluctuations in the generally constant plateau pressure.

At the end of its 20 second "on" time, the pulse timer sequences to its 20 second "off" time and shuts off the compressor output. Valve 23 or 25 exhausts air through the respective valve from port 2 to port 3 during the "off" time, causing the bladders to deflate to atmospheric pressure with approximately 15 seconds. At the end of its 20 second "off" time, the pulse timer starts the compressor output and switches the inflation to the bladder of the opposite leg. Initiation of the "on" cycle also triggers the delay timer which begins its 5 second count. After the second leg bladder has been inflated and deflated, the cycle, which takes approximately 80 seconds, has been completed.

It has been found that the very fast rise time, the peak pressure, the period of pressure of above 30 mm Hg, and the generally constant plateau pressure for at least 10 seconds, provides improved blood flow stimulation. Such pressure and time profiles are generated by the interreaction of the pulse timer, the delay timer, the compressor and its pressure relief valves.

The schematic electrical and air diagrams describing the interrelationship of these parts is shown in FIG. 4. Here a grounding type plug 10 for connecting to a 120 volt, 60 Hz power supply is provided. The current L1 is routed through the cord, fuse 11, and through a lighted double pole on-off switch 12 to a pulse timer 13. The constant output pulses of the timer consist of 20 seconds "on" time followed by 20 seconds "off" time.

A first "on" pulse energizes the coil of an alternating relay 14 latching to a relay armature causing contact 15 and 16 to be made. Contact 17 has assumed the position designated as R during the previous "off" period of the timer. The two positions of contact 17 indicate right bladder and left bladder. The circuit as shown in FIG. 4 is completed to L2.

Current flows from contact 15 to the capacitor 18 of motor 19 which drives compressor 20. The circuit is also complete to the 5 second time delay relay 21 that is connected to a solenoid actuated valve 22. During this condition, the motor driven compressor operates and the solenoid operated air valve 23 controlling the right bladder opens.

Simultaneous to the above, the time delay relay 21, which is in series with the solenoid operated (normally closed) air escape valve 22 prevents the solenoid from being energized until 5 seconds have elapsed. This actions activates regulator 30, causing the right bladder to fill to the established 60 mm Hg pressure within the specified time of 5 seconds. The pressure indicator light 24 is illuminated.

After 5 seconds have elapsed, the time delay relay completes the circuit to the solenoid actuated escape valve 22 allowing air to escape at a balanced rate from pressure relief valve 26 and maintain the generally constant peak pressure.

Upon completion of the pulse timer's "on" pulse of 20 seconds, the relay coil 14 becomes deenergized, releasing the armature and interrupting contacts 15 and 16. Thus, current is interrupted to the motor driving the compressor and solenoid valves 23 or 25. Also, during the release of relay armature 14, contact 17 assumes the left leg position L.

During the ensuing 20 second "off" period of the pulse timer, air pressure in the right bladder is relieved through the air conduit through exhaust port 3 of valve 23.

Another 20 second "on" period follows, again causing contacts 15 and 16 to be made. Contact 17 has assumed position L during the preceding "off" period of the pulse timer. The solenoid air valve 25 of the left bladder opens. The sequence of operation is as described for the previous "on" period, except that air is now directed to the left leg bladder. The indicator light 24 is illuminated. Another 20 second "off" period of the pulse timer follows, completing the total cycle time of 80 seconds. The cycle is then repeated.

It is important that there be a primary pulse timer and a secondary delay timer to perform the functions described above. If desired, these two timers could be consolidated into a single component which performs these two separate timing functions.

If desired, solenoid valves 23 and 25 could be consolidated into a single 4-way valve to reduce cost. The function of the 4-way valve would be the same as the two 3-way valves.

Various types of timers can be used for the pulse timer and the time delay relay. Examples are the solid state Schmidt trigger, R-C circuit, or a binary counter device. In FIG. 4, all the components within the dotted line could be replaced with a compact solid state timer board assembly. If desired, the solid state timer board assembly could be designed with an adjustment (to be made by qualified technical personel) to alter the peak spike pattern.

The motor, compressor, timers, solenoid valves, etc. are preferably compactly packaged in a small case for easy portability.

In the foregoing description, a specific example has been used to describe the invention. It is understood by those skilled in the art that certain modifications can be made to this example without departing from the spirit and scope of the invention.

I claim:

1. A method of controlling the inflation rate and pressure in a body compression device for aiding blood circulation comprising the steps of:

(a) utilizing a gas pressure at an output of a gas supply source that is greater than the desired operating pressure for the device;

(b) venting a portion of the gas from the output to establish a control pressure less than said gas supply pressure;

(c) dispensing gas at the control pressure into the device for a measured period of time which automatically provides a predetermined inflation rate and operating pressure; and (d) maintaining a generally constant plateau pressure for a measured period of time by opening a balancing vent means downstream.

2. A method as set forth in claim 1, wherein the controlled gas is vented and dispensed simultaneously.

3. A method as set forth in claim 1, wherein the output pressure is above 520 mm Hg (10 psi).

4. A method as set forth in claim 1, wherein the control pressure is within the range of 50 to 520 mm Hg (1 to 10 psi).

5. A method as set forth in claim 1, wherein the device's peak pressure is below 101 mm Hg (2 psi).

6. A method as set forth in claim 1, wherein the device is inflated to a pressure above 30 mm Hg (0.6 psi) in less than 7 seconds, and maintained at or above this pressure for a period of 15 to 25 seconds.

7. A method as set forth in claim 1, wherein the device is inflated to a pressure of 50 to 70 mm Hg (1 to 1.4 psi) within a period of 3–7 seconds.

8. A method as set forth in claim 1, wherein the generally constant plateau pressure is in the range of 50 to 70 mm Hg (1 to 1.4 psi).

9. A method as set forth in claim 8, wherein the generally constant plateau pressure is maintained for a period greater than 10 seconds.

10. A method as set forth in claim 1, wherein the device is deflated by actuating a control valve that exhausts air to the atmosphere.

11. A method as set forth in claim 1, wherein the method includes applying pulses alternately to a plurality of limb compression devices.

12. A method as set forth in claim 1, wherein the gas supply source is an air compressor with a motor; and the motor is on for a period of 15 to 25 seconds during compression, and is shut off for a subsequent period of 15 to 25 seconds in a repeating cycle.

13. Apparatus for supplying intermittent pressure to a body compression device for aiding in blood circulation comprising: a gas pressure source capable of generating gas pressures sufficiently high to inflate such device to a pressure of 50 to 70 mm Hg (1 to 1.4 psi) within 3 to 7 seconds; a first timer for alternately starting and stopping gas flow from the source to the device; a second timer coupled to the first timer for actuating means to limit peak pressure in the device; and said apparatus has a downstream balancing vent means operably connected to said timers for maintaining such device in inflated condition at a generally constant plateau pressure which varies less than 8 mm Hg for a period greater than 10 seconds.

14. Apparatus as set forth in claim 13, wherein the first timer is a pulse timer with a preset "off" time of 15–25 seconds alternately with a preset "on" time of 15–25 seconds.

15. Apparatus as set forth in claim 13, wherein the second timer is a delay timer preset to begin a delay count at the initiation of an "on" period of the first timer.

16. Apparatus for supplying intermittent pressure to a body compression device for aiding in blood circulation comprising: an air compressor capable of generating air pressure sufficiently high to inflate the device to above 30 mm Hg in less than 7 seconds; a downstream balancing vent valve having a relief pressure and flow capacity balanced against the air being supplied to such device to maintain a generally constant plateau pressure in the device for a period of time while the compressor is running; and timing means on the apparatus for signaling the opening and closing of such balancing vent valve.

17. Apparatus as set forth in claim 16, wherein the balance occurs at a pressure in the range of 50 to 70 mm Hg.

18. Apparatus for supplying intermittent pressure to a body compression device for aiding in blood circulation comprising: an air compressor capable of generating air pressure substantially greater than the desired peak pressure for such device; said apparatus including timing means coupled to a downstream balancing vent means having a flow capacity and pressure balanced against the air being supplied to the device, whereby a generally constant plateau pressure is maintained by the balanced vent valve while the compressor is simultaneously delivering compressed air to the device.

19. Apparatus for supplying intermittent pressure to a body compression device for aiding blood circulation comprising: an air compressor; a downstream balancing vent valve connected between the compressor and device; and timing means to actuate the balancing vent valve and also air flow from the compressor to provide a generally constant plateau pressure that varies less than 8 mm Hg for a period of more than 10 seconds.

20. Apparatus as set forth in claim 19, wherein the timing means, compressor, and balancing vent valve establish a peak pressure in the range of 50 to 70 mm Hg (1 to 1.4 psi) within approximately 5 seconds.

* * * * *